US005791012A

United States Patent [19]

Carver, Sr.

[11] Patent Number: 5,791,012

[45] Date of Patent: Aug. 11, 1998

[54] SAFETY CAGE FOR HIGH SUCTION INDUSTRIAL VACUUMS

[76] Inventor: Michael Ray Carver, Sr., 6408 Robertson Ave., Nashville, Tenn. 37209

[21] Appl. No.: 661,722

[22] Filed: Jun. 11, 1996

[51] Int. Cl.[6] ..... A47L 9/02

[52] U.S. Cl. ..... 15/422; 15/410

[58] Field of Search ..... 15/422, 339

[56] References Cited

U.S. PATENT DOCUMENTS

| | | | |
|---|---|---|---|
| 1,944,976 | 1/1934 | Hamilton . | |
| 2,711,554 | 6/1955 | Doyle . | |
| 2,737,680 | 3/1956 | Robison . | |
| 2,778,441 | 1/1957 | Herriott | 15/422 X |
| 3,444,581 | 5/1969 | Daneman | 15/414 X |
| 3,710,412 | 1/1973 | Hollowell | 15/352 |
| 3,733,640 | 5/1973 | Finberg et al. | 15/422 X |
| 4,265,621 | 5/1981 | McVey | 15/422 X |
| 4,995,138 | 2/1991 | Pullen . | |
| 5,033,159 | 7/1991 | Whilden, Jr. et al. . | |

FOREIGN PATENT DOCUMENTS

| | | | |
|---|---|---|---|
| 3500106 | 7/1986 | Germany | 15/422 |

*Primary Examiner*—Chris K. Moore

*Attorney, Agent, or Firm*—Waddey & Patterson; Mark J. Patterson

[57] ABSTRACT

The present invention discloses a safety cage for high suction industrial vacuums. The cage is fabricated from an open perimeter structure having an open end and intake end. Proximate the intake end there is an end guard which serves to prevent large objects from being sucked into the opened end of the cage. Flanges are provided at the open end to engage the intake of the hose. The perimeter structure is created from the cage rings and cage supports which form a rigid perimeter structure which keeps the hose from collapsing. A end guard is provided on the side of the perimeter structure to allow easy manipulation of the cage. Holes in the perimeter structure provide for receiving set screws which engage the side wall of the vacuum hose.

12 Claims, 3 Drawing Sheets

SAFETY CAGE FOR HIGH SUCTION INDUSTRIAL VACUUMS

APPLICATION FOR

UNITED STATES LETTERS PATENT

Be it known that I, Michael Ray Carver, Sr., a citizen of the United States, residing at 6408 Robertson Avenue, Nashville, Tenn. 37209, have invented a new and useful "Safety Cage for High Suction Industrial Vacuums."

BACKGROUND OF THE INVENTION

The present invention relates generally to vacuum guards and more particularly to a safety cage for a high suction industrial vacuum having an elongated vacuum hose.

It will be appreciated by those skilled in the art that cleaning and debris removal today is frequently done through use of vacuums, including high suction industrial vacuums mounted to trucks and the like. The vacuums take many shapes and sizes. One common type uses a flexible elongated hose running from the vacuum source to the hose intake. Items to be collected are pulled into the intake and through the hose by the suction generated at the vacuum source.

Unfortunately, these vacuum hoses can cause problems in several ways. The operator or other individual can be injured by the extreme suction created at the intake, drawing air in as high as 7500 CFM. Secondly, the vacuum hose intake can become stuck against a surface or can be clogged from trying to pull in material too large to go through the intake. Also, if clogged, a pipe can collapse and cause shut down of the unit thereby creating blower damage to the vacuum equipment.

There have been several attempts to address the problems associated with high suction present at the intake of the hose. Examples of these attempted solutions are described in U.S. Pat. Nos. 1,944,976; 2,711,554; 2,737,680; and 2,798,243.

Another device relating to high strength industrial vacuums is U.S. Pat. No. 4,995,138. However, the device of the '138 patent fails to provide any way of preventing the hose from closing shut because any support is along only two sides by the extensible arms.

What is needed, then, is a safety device which keeps the operator or other individual from being injured by the extreme suction created by the vacuum unit. This needed system must prevent the pipe from sticking to large objects or surfaces. This device must also prevent the collapse of the cage and shut down of the unit. Such a safety device must be easy to use and manufacture. This system must provide engagement with the vacuum hose. This system is presently lacking in the prior art.

SUMMARY OF THE INVENTION

The present invention discloses a safety cage for high suction industrial vacuums. The cage creates a perimeter structure having an open end and intake end. Proximate the intake end of the cage is an end guard which also serves to prevent large objects from being sucked into the open end of the cage. Flanges are provided at the open end to engage the intake of the hose. The perimeter structure is created from cage rings and cage supports which form a rigid perimeter structure which keeps the hose from collapsing. A handle is provided on the side of the perimeter structure to allow easy transport of the cage. Holes in the perimeter structure provide for receiving set screws which also engage the sides of the vacuum.

Accordingly, one object of the present invention is to provide a safety cage.

Another object of the present invention is to provide a device which keeps individuals from being injured by the vacuum.

Another object of the present invention is to provide a device which prevents the hose from sticking to large objects.

Another object of the present invention is to provide a cage which prevents collapse of the hose.

Another object of the present invention is to provide a device which is easy and economical to manufacture.

DESCRIPTION OF THE PREFERRED EMBODIMENT

Figure 1:
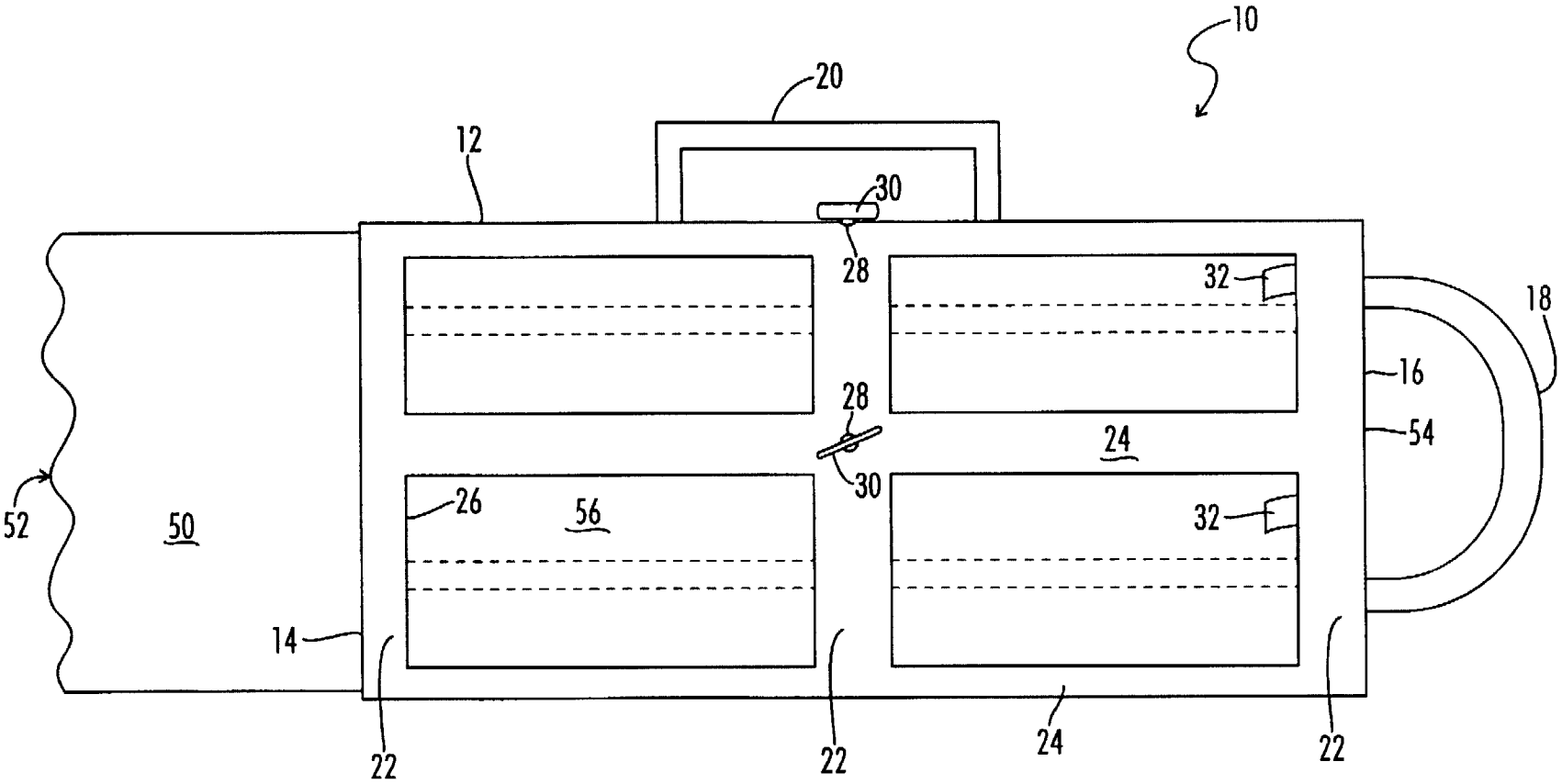
FIG. 1 is a side view of the safety cage of the present invention as it engages a hose.

Referring now to FIG. 1, there is shown generally at 10 the safety cage for a high suction industrial vacuum of the present invention. Cage 10 has a perimeter structure 12 with an open end 14 which receives hose 50. Opposite open end 14 there is an intake end 16. Flanges 32 are attached to the perimeter structure 12 proximate intake end 16. The flanges 32 receive and engage the intake end edge of wall 56 of hose 50. An end guard 18 is attach ed to the perimeter structure proximate intake end 16, to prevent large it ems from being pulled into intake 54 of hose 50. A handle 20 is also attached to the center outside of the perimeter structure 12 so that the cage 10 and the end of the hose 50 can be easily supported and manipulated by the operator.

The perimeter structure 12 can be tubular with solid walls. However, to reduce the weight of the cage 10, it is preferred that the cage 10 have an open structure. Accordingly, in a preferred embodiment of the invention, the cage 10 is fabricated by welding a series of rolled steel cage rings 22 in transverse positions along multiple horizontal cage supports 24, also made from rolled steel. Cage rings 22 and cage supports 24 combine to create a rigid and strong perimeter structure 12. Because the rings 22 are spaced longitudinally along supports 24 , void areas 26 are defined which reduce the weight of cage 10.

To provide a means of removably securing the cage 10 to the hose 50, threaded holes 28 are machined through one or more rings 22 to receive thumb or set screws 30. Once the cage 10 is properly positioned along the hose 50, the set screws 30 are tightened against the side wall 56 of hose 50.

Figure 2:
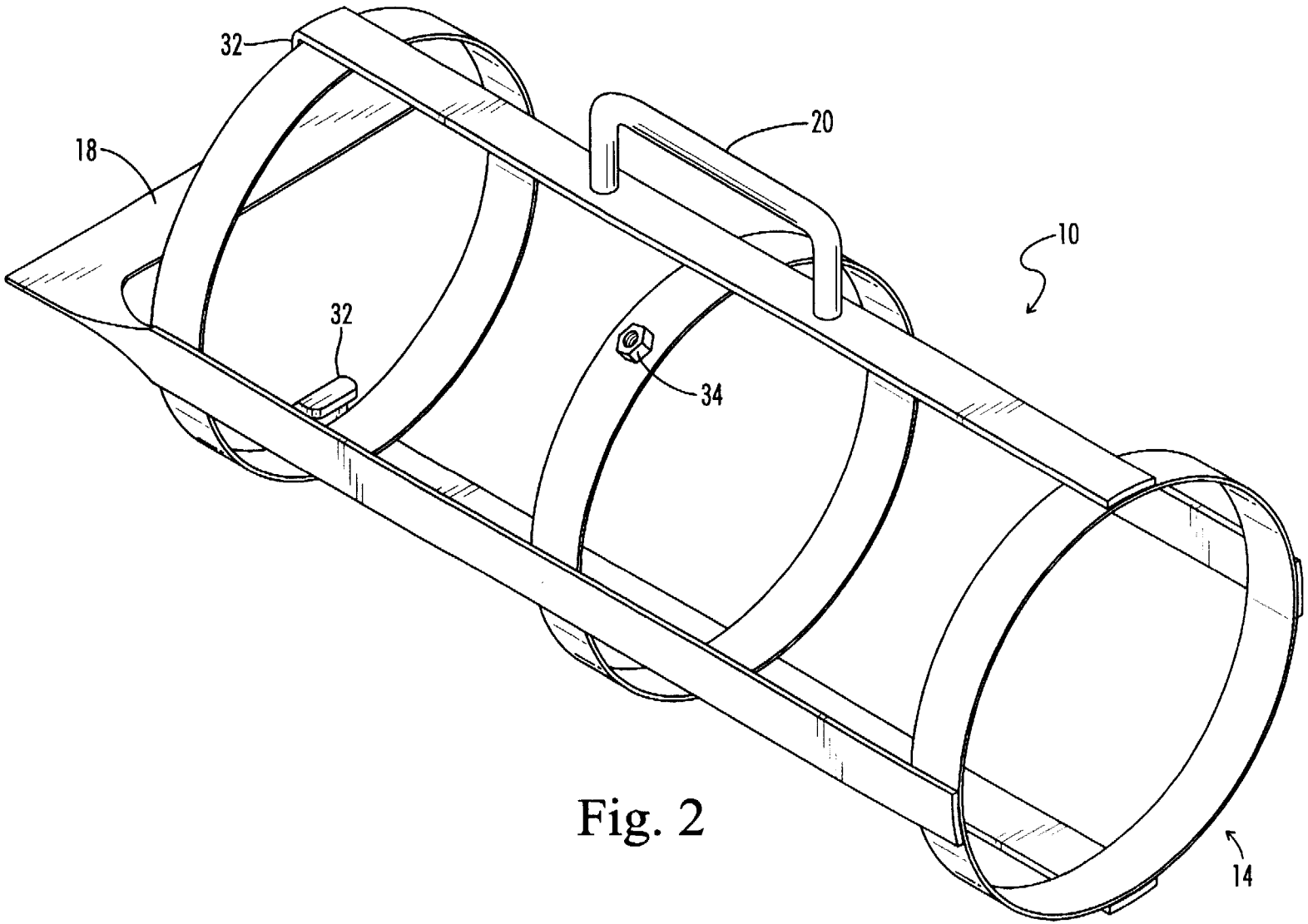
FIG. 2 is a perspective view of the safety cage of the present invention.
Figure 3:
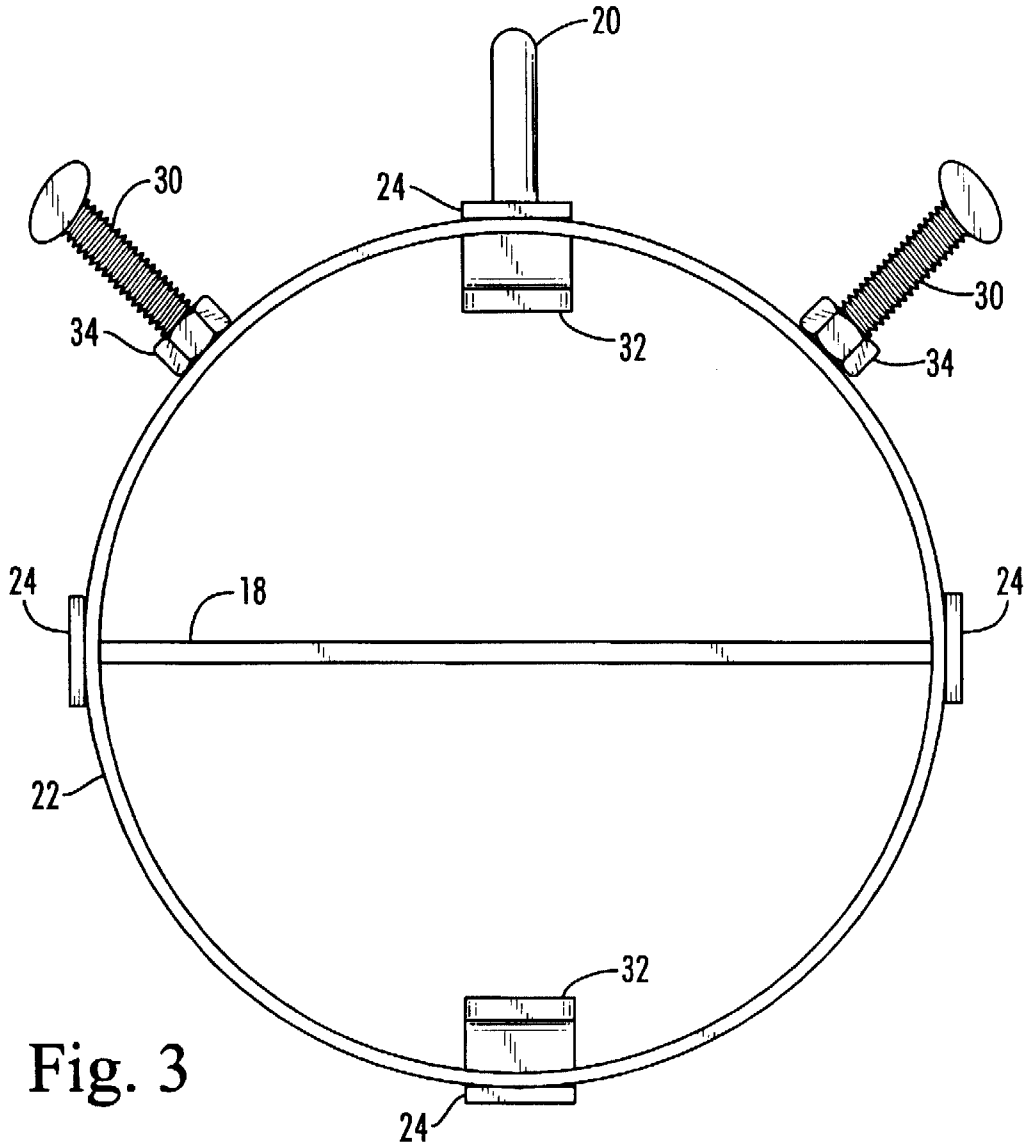
FIG. 3 is an end view of the safety cage of the present invention.

FIGS. 2 and 3 provide better views of flanges 32 and screws 30. As can be seen, flanges 32 are substantially L-shaped which enable them to receive the edge of the hose wall (56 in FIG. 1) proximate the intake (54 in FIG. 1). If preferred, rather than using threaded holes (28 in FIG. 1), holes 28 can be smooth walled and a threaded hex nut 34 attached to the inner surface of the rings 22 opposite the set screws (30 in FIG. 1).

In the preferred embodiment, four supports 24 are used.

The end guard 18 should extend away from the intake end of the perimeter structure 12 as seen on FIG. 1 so that objects and surfaces cannot fully engage or substantially restrict air flow through the hose intake 54.

To use the safety cage 10, the open end 14 is placed over the intake 54 of the vacuum hose 50, such as industry standard ADS vacuum hose. The cage 10 slides over hose 50 until the end guard 18 is proximate the hose intake 54 and the flanges 32 engages the edge of hose wall 56 at the intake 54 The cage 10 is then secured to the hose wall with set screws 30 or similar technique. The operator then grasps the handle 20 and the vacuum source 52 is energized. By engaging the edge of the hose wall 56 at the hose intake 54, the L-shaped flanges 32 and cage 10 reinforce the hose wall 56 to reduce the risk of collapse if the intake 54 should be blocked.

Thus, although there have been described particular embodiments of the present invention of a new and useful safety cage for high suction industrial vacuums, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A safety cage for a high-suction industrial vacuum having an elongated hose comprising:

a. a perimeter structure having an open end adapted to receive a section of the hose at an open end of the hose whereby a wall of the hose is in a fixed position internal to the structure and an intake end opposite the open end and adapted to receive an edge of the hose wall at the open end of the hose; and b. a end guard attached to the perimeter structure proximate the intake end.

2. The safety cage of claim 1 wherein the perimeter structure comprises an open frame having void areas.

3. The safety cage of claim 2 wherein the open frame comprises a plurality of cage rings transversely attached to multiple horizontal cage supports.

4. The safety cage of claim 3 further comprising attachment means to removably secure the cage to the wall of the hose.

5. The safety cage of claim 4 wherein the attachment means comprises adjustable screws which pass transversely through the frame to engage the wall of the elongated hose.

6. The safety cage of claim 5 further comprising locking means to receive and engage the end of the hose wall at the intake end of the hose to prevent further longitudinal movement of cage the along the hose and to reinforce the wall of the hose at the intake end.

7. The safety cage of claim 6 wherein the locking means comprises a plurality of flanges attached to the frame proximate the intake end of the frame.

8. A safety cage for a high-suction industrial vacuum having an elongated hose comprising:

a. a perimeter structure having an open end and an intake end, the perimeter structure formed from cage rings and connecting cage supports, the rings and the supports defining voids in the perimeter structure, the perimeter structure having threaded holes for receiving set screws which engage the elongated hose whereby the hose is retained in a fixed position inside the cage;

b. an end guard attached to the perimeter structure proximate the intake end to prevent large items from entering the elongated hose;

and c. a plurality of flanges attached to the perimeter structure proximate the intake end to receive an edge of intake end wall of the elongated hose.

9. A safety cage for a high-suction industrial vacuum having an elongated hose comprising:

a. a rigid perimeter structure having an open end and an intake end, the perimeter structure having plural rings joined by plural supports to define a cage that receives and secures a section of the hose at an open end of the hose in a fixed position inside the cage; and b. an end guard attached to the cage at the intake end and extending away from the open end of the hose.

10. The safety cage of claim 9 wherein the perimeter structure includes means for receiving set screws which engage the elongated hose.

11. The safety cage of claim 10 further comprising plural flanges attached to the perimeter structure proximate the intake end to receive an edge of the open end of the elongated hose.

12. The safety cage of claim 9 further comprising a handle attached to and extending away from the perimeter structure.

* * * * *